US010627059B2

(12) United States Patent
Duckworth et al.

(10) Patent No.: US 10,627,059 B2
(45) Date of Patent: Apr. 21, 2020

(54) WALL PACK LIGHT FIXTURES

(71) Applicant: HUBBELL INCORPORATED, Shelton, CT (US)

(72) Inventors: Jason Edward Duckworth, Simpsonville, SC (US); Douglas S. Hodges, Anderson, SC (US); Ormand Gilbert Anderson, Jr., Greenville, SC (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 15/969,310

(22) Filed: May 2, 2018

(65) Prior Publication Data

US 2018/0320842 A1 Nov. 8, 2018

Related U.S. Application Data

(60) Provisional application No. 62/502,619, filed on May 6, 2017.

(51) Int. Cl.

| | |
|---|---|
| ***F21V 15/01*** | (2006.01) |
| ***F21S 8/00*** | (2006.01) |
| ***F21V 21/30*** | (2006.01) |
| ***F21S 9/02*** | (2006.01) |
| ***F21V 17/10*** | (2006.01) |
| *F21V 21/04* | (2006.01) |

(52) U.S. Cl.

CPC ..... *F21S 8/036* (2013.01); *F21S 9/02* (2013.01); *F21V 15/01* (2013.01); *F21V 17/107* (2013.01); *F21V 21/30* (2013.01); *F21S 9/022* (2013.01); *F21V 21/047* (2013.01)

(58) Field of Classification Search

CPC ..... F21S 9/02; F21S 8/036; F21V 21/047; F21V 15/01

USPC ..... 362/147

See application file for complete search history.

(56) References Cited

U.S. PATENT DOCUMENTS

| | | | | |
|---|---|---|---|---|
| 5,590,953 | A * | 1/1997 | Haslam | F21S 8/033 362/147 |
| 6,378,173 | B1 | 4/2002 | Ho et al. | |
| 8,777,460 | B2 | 7/2014 | Newton | |
| 9,404,628 | B2 | 8/2016 | Newton et al. | |
| 9,869,457 | B1 * | 1/2018 | Lin | F21S 8/033 |
| 2007/0133196 | A1 * | 6/2007 | Ermeti | F21L 4/005 362/157 |
| 2012/0287613 | A1 * | 11/2012 | Hamel | F21V 29/004 362/184 |
| 2014/0321131 | A1 | 10/2014 | Newton | |

FOREIGN PATENT DOCUMENTS

| | | | |
|---|---|---|---|
| CN | 204578091 | U | 8/2015 |
| WO | 2017054091 | A1 | 4/2017 |

OTHER PUBLICATIONS

PCT International Search Report and Written Opinion dated Jul. 18, 2018 from corresponding Application No. PCT/US18/30649, 12 pages.

* cited by examiner

*Primary Examiner* — Christopher M Raabe
(74) *Attorney, Agent, or Firm* — Dilworth IP, LLC

(57) ABSTRACT

The present disclosure provides wall pack light fixtures having a hinge, the hinge having a first portion and a second portion rotatably coupled to the first portion, a front cover, the front cover connected to the first portion of the hinge, the front cover including a light engine, and a rear enclosure, the rear enclosure connected to the second portion of the hinge.

19 Claims, 21 Drawing Sheets

WALL PACK LIGHT FIXTURES

BACKGROUND

The present disclosure relates generally to artificial lighting fixtures, more specifically, wall pack light fixtures configured for mounting, protecting and supporting electrical connection with light elements contained in the wall pack light fixtures to at least one of a wall, a pole and support structure.

Artificial lighting has proven to be useful in a wide variety of locations and situations, including both indoors and outdoors. One form of useful lighting is known as a wall pack light fixture, or more simply, as a wall pack. A wall pack is also sometimes known as a luminaire enclosure. A wall pack light fixture may enclose one or more electrical lighting elements and associated electrical conductors while supporting the reception and use of electrical power by those lighting elements. Because wall pack light fixtures are generally intended for outdoor environments, although they may also be used in indoor environments, they tend include a housing designed to be more robust than typical indoor lighting fixtures. Typically, the housing provides some measure of protection against outdoor weather hazards such as fresh water, salt water, temperature extremes, sunlight, animals, dust, debris, and even occasionally, corrosive chemicals, combustible materials, explosive materials, etc., that could otherwise affect the operation of the lighting elements and the electrical conductors.

A wall pack light fixture is often designed for mounting on a pole, wall or other elevated structure in the outdoors environment. Some wall pack light fixtures include a mounting portion for mounting to the elevated structure and a cover portion for covering, at least in part, the lighting elements and electrical conductors to protect them from hazards in the outdoor environment. The mounting portion and the cover portion are physically coupled together.

While installation of a wall pack light fixture may occur in a variety of ways, often installation includes physically coupling the mounting portion to an elevated structure. In addition to physically coupling the mounting portion, electrical contacts in the wall pack lighting fixture are conductively coupled to external electrical wiring for providing electrical power to the lighting elements. Once a physical and electrical coupling is made, the cover portion is attached to the mounting portion.

Unfortunately, existing wall pack light fixtures have certain associated limitations and difficulties. For example, wall pack light fixtures light fixtures can be difficult to install, control and service after installation. It would also be desirable to eliminate or mitigate one or more of the limitations and difficulties associated with wall pack light fixtures.

SUMMARY

In some embodiments, the present disclosure describes a wall pack light fixture including a hinge, the hinge having a first portion and a second portion rotatably coupled to the first portion, a front cover, the front cover connected to the first portion of the hinge, the front cover including a light engine, and a rear enclosure, the rear enclosure connected to the second portion of the hinge. A rear facing portion of the front cover acts as a front cover contact surface for receiving contact from the front facing edge of the rear enclosure. A seal is formed where the front cover contact surface engages the front facing edge of the rear enclosure. In preferred embodiments of the invention, the hinge is an offset hinge. As used herein, an offset hinge is a hinge that permits a closure of the front cover so that the front cover closes substantially perpendicularly against the rear enclosure as it is making closing contact. This permits uniform pressure between the rear enclosure and the front cover contact surface and can enhance the seal between the rear enclosure and the front cover contact surface. Preferred offset hinges offset the pivot point of the hinge from the plane of the contact surface to enhance uniform contacting pressure upon closing.

In some other embodiments, the present disclosure describes a wall pack light fixture including a hinge, the hinge having a first portion and a second portion rotatably coupled to the first portion, a front cover, the front cover connected to the first portion of the hinge, the front cover including a light engine, and a rear enclosure, the rear enclosure connected to the second portion of the hinge, the rear enclosure including an occupancy sensor.

In some still other embodiments, the present disclosure describes a wall pack light fixture including a hinge, the hinge having a first portion and a second portion rotatably coupled to the first portion, a front cover, the front cover connected to the first portion of the hinge, the front cover including a light engine, wherein the light engine includes at least one of a light emitting diode (LED), a halogen light and an incandescent light, and a rear enclosure, the rear enclosure connected to the second portion of the hinge, the rear enclosure including an occupancy sensor and a battery backup, wherein the battery backup is electrically connected to the light engine and configured to provide electrical energy to the light engine in response to detection of an occupant by the occupancy sensor.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

The following description and drawings are illustrative and are not to be construed as limiting. Numerous specific details are described to provide a thorough understanding of the disclosure. However, in certain instances, well known or conventional details are not described in order to avoid obscuring the description.

Reference in this specification to "one embodiment," "an embodiment" or the like means that a particular feature, structure, characteristic, advantage or benefit described in connection with the embodiment may be included in at least one embodiment of the disclosure, but may not be exhibited by other embodiments. The appearances of the phrase "in one embodiment" in various places in the specification are not necessarily all referring to the same embodiment, nor are separate or alternative embodiments mutually exclusive of other embodiments. Similarly, various requirements are described which may be requirements for some embodiments but not for other embodiments. The specification and drawings are to be regarded in an illustrative sense rather than a restrictive sense. Various modifications may be made thereto without departing from the spirit and scope as set forth in the claims.

The present disclosure describes wall pack light fixtures eliminating or mitigating one or more of the limitations and difficulties associated with other wall pack light fixtures. As described herein, some embodiments include a rear contact surface and a front cover connected by a hinge to a rear enclosure to make installation and servicing easier. When closed, the front cover contacts the rear contact surface and seals the components within the wall pack light fixture from the elements. The hinge is configured in such a way as to permit the wall pack light fixture to remain open, exposing the inside portions, to avoid having to hold the wall pack light fixture open in some situations. This feature simplifies installation and servicing, for example, by freeing a hand of an installer or servicer, thereby enabling safer and more effective installation and service. In preferred embodiments of the invention, the hinge is an offset hinge and in any event, is configured to permit the front cover to press uniformly and close perpendicularly with uniform pressure against the rear contact surface. Furthermore, as described herein, some embodiments include an occupancy sensor adapted to control the wall pack light fixture to provide light when an area is occupied. This feature provides better control to provide light when it deemed useful and saving power when light is deemed not necessary. Still further, as described herein, some embodiments include a battery backup adapted to power the wall pack light fixture to provide light. In some embodiments, this feature provides power for lighting in lieu of a primary electrical power source, such as when primary power is lost.

Figure 1:
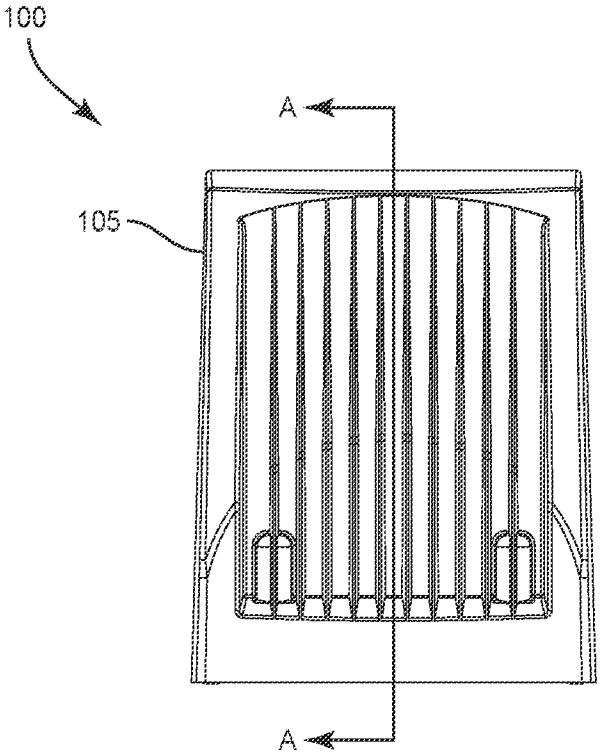
FIG. 1 is a front plan view of an exemplary embodiment of wall pack light fixture according to the present disclosure.
Figure 2:
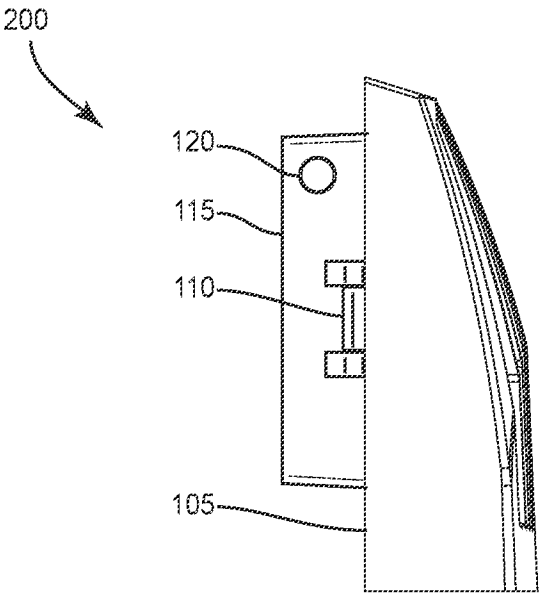
FIG. 2 is a left side plan view of an exemplary embodiment of wall pack light fixture according to the present disclosure.

Referring to FIG. 1, a front plan view of an exemplary embodiment of wall pack light fixture 100 according to the present disclosure is shown. The wall pack light fixture 100 includes a front cover 105. Referring briefly to FIG. 2, the front cover 105 is movably attached by a hinge 110 to a rear enclosure 115 to permit access to an interior of the wall pack light fixture 100 formed by the front cover, hinge and rear enclosure. Returning to FIG. 1, in some embodiments, the front cover 105 includes vertical fins, also known as ribs. In some embodiments, the vertical fins are for heat dissipation, while in other embodiments the vertical fins are decorative. In some embodiments, the front cover is made of materials suitable for direct exposure to outside conditions that include one or more of fresh water, salt water, temperature extremes, sunlight, animals, dust, debris, corrosive chemicals, combustible materials and explosive materials. The front cover 105 extends rearward from the front opening of the rear enclosure 115, such that the front of the rear enclosure is recessed into the front cover 105. In some embodiments, the front cover substantially protects the interior from at least one such outside condition. In some embodiments, the front cover 105 is made from die cast aluminum, although the front cover is not limited to any particular metal or material. In some embodiments, the front cover 105 is coated with a polyester powder applied with a static charge.

Referring to FIG. 2, a left side plan view of an exemplary embodiment of wall pack light fixture 200 according to the present disclosure is shown. The wall pack light fixture 200 includes the front cover 105 movably attached by the hinge 110 to the rear enclosure 115 to permit access to the interior of the wall pack light fixture 200 formed by the front cover, hinge and rear enclosure. In some embodiments, the hinge 110 is made of materials suitable for direct exposure to outside conditions that include one or more of fresh water, salt water, temperature extremes, sunlight, animals, dust, debris, corrosive chemicals, combustible materials and explosive materials. In some embodiments, the hinge 110 substantially protects the interior from at least one such outside condition. In some embodiments, the hinge 110 is made from die cast aluminum, although the hinge is not limited to any particular metal or material. In some embodiments, the hinge 110 is coated on exterior portions, so as not to interfere with hinge movement, with a polyester powder applied with a static charge.

In some embodiments, the rear enclosure 115 is made of materials suitable for direct exposure to outside conditions that include one or more of fresh water, salt water, temperature extremes, sunlight, animals, dust, debris, corrosive chemicals, combustible materials and explosive materials. In some embodiments, rear enclosure 115 substantially protects the interior from at least one such outside condition. In some embodiments, the rear enclosure 115 is made from die cast aluminum, although the rear enclosure is not limited to any particular metal or material. In some embodiments, the rear enclosure 115 is coated with a polyester powder applied with a static charge.

In some embodiments, the wall pack light fixture 200 includes a left side access aperture 120. In some embodiments, the left side access aperture 120 enables access to the interior. In some embodiments, the left side access aperture 120 enables mounting at least one of a light sensor, a switch and an electrical cable, depending on desired application for the wall pack light fixture. In some embodiments, the left side access aperture 120 is closed with a flush screw. In some embodiments, the left side access aperture 120 is closed with a recessed screw.

Figure 3:
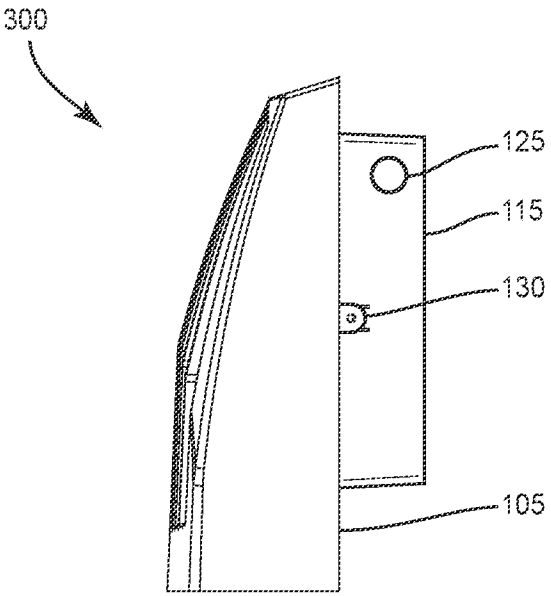
FIG. 3 is a right side plan view of an exemplary embodiment of wall pack light fixture according to the present disclosure.

Referring to FIG. 3, a right side plan view of an exemplary embodiment of wall pack light fixture 300 according to the present disclosure is shown. The wall pack light fixture 300 includes the front cover 105 movably attached by the hinge 110 (not shown here) to the rear enclosure 115 to permit access to the interior of the wall pack light fixture 300 formed by the front cover, hinge and rear enclosure.

In some embodiments, the wall pack light fixture 300 includes a right side access aperture 125. In some embodiments, the right side access aperture 125 enables access to the interior. In some embodiments, the right side access aperture 125 enables mounting at least one of a light sensor, a switch and an electrical cable, depending on desired application for the wall pack light fixture. In some embodiments, the right side access aperture 125 is closed with a flush screw. In some embodiments, the right side access aperture 125 is closed with a recessed screw.

In some embodiments, the wall pack light fixture 300 includes a latch 130. In some embodiments, the latch 130 includes a closing screw used to hold the rear enclosure closed by threading through both a portion of the rear enclosure 115 and the front cover 105.

Figure 4:
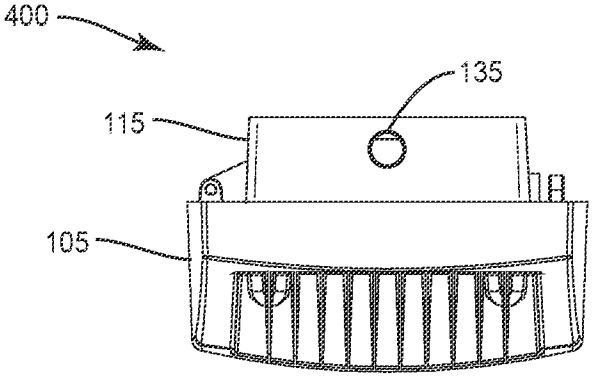
FIG. 4 is a top plan view of an exemplary embodiment of wall pack light fixture according to the present disclosure.

Referring to FIG. 4, a top plan view of an exemplary embodiment of wall pack light fixture 400 according to the present disclosure is shown. The wall pack light fixture 400 includes the front cover 105 movably attached by the hinge 110 (not shown here) to the rear enclosure 115 to permit access to the interior of the wall pack light fixture 400 formed by the front cover, hinge and rear enclosure.

In some embodiments, the wall pack light fixture 400 includes a top access aperture 135. In some embodiments, the top access aperture 135 enables access to the interior. In some embodiments, the top access aperture 135 enables mounting at least one of a light sensor, a switch and an electrical cable, depending on desired application for the wall pack light fixture 400. In some embodiments, the top access aperture 135 is closed with a flush screw. In some embodiments, the top access aperture 135 is closed with a recessed screw.

Figure 5:
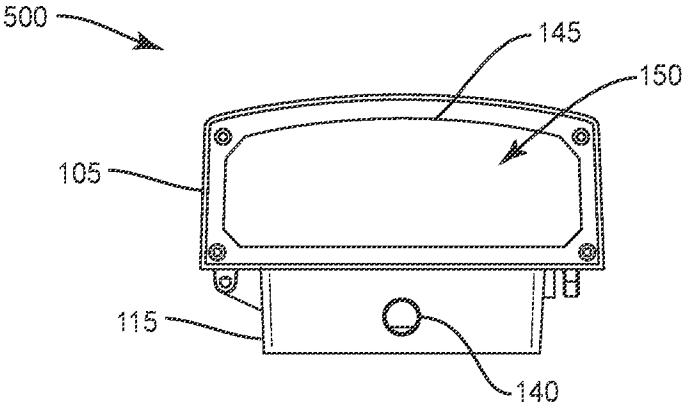
FIG. 5 is a bottom plan view of an exemplary embodiment of wall pack light fixture according to the present disclosure.

Referring to FIG. 5, a bottom plan view of an exemplary embodiment of wall pack light fixture 500 according to the present disclosure is shown. The wall pack light fixture 500 includes the front cover 105 movably attached by the hinge 110 (not shown here) to the rear enclosure 115 to permit access to the interior of the wall pack light fixture 500 formed by the front cover, hinge and rear enclosure. In some embodiments, the wall pack light fixture 500 includes a bottom access aperture 140 for mounting at least one of a light sensor, a switch and an electrical cable, depending on desired application. In some embodiments, the bottom access aperture 125 is closed with a flush screw. In some embodiments, the bottom access aperture 125 is closed with a recessed screw.

In some embodiments, the wall pack light fixture 500 includes a bottom access aperture 140. In some embodiments, the bottom access aperture 140 enables access to the interior. In some embodiments, the bottom access aperture 140 enables mounting at least one of a light sensor, a switch and an electrical cable, depending on desired application for the wall pack light fixture. In some embodiments, the bottom access aperture 140 is closed with a flush screw. In some embodiments, the bottom access aperture 140 is closed with a recessed screw.

Figure 34:
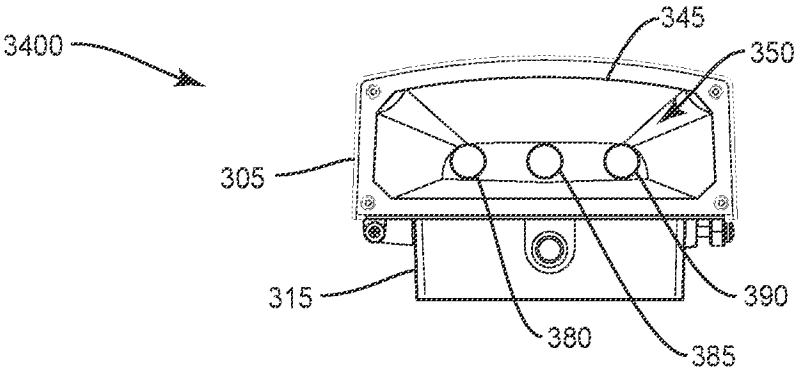
FIG. 34 is a bottom plan view of an exemplary embodiment of wall pack light fixture according to the present disclosure.
Figure 36:
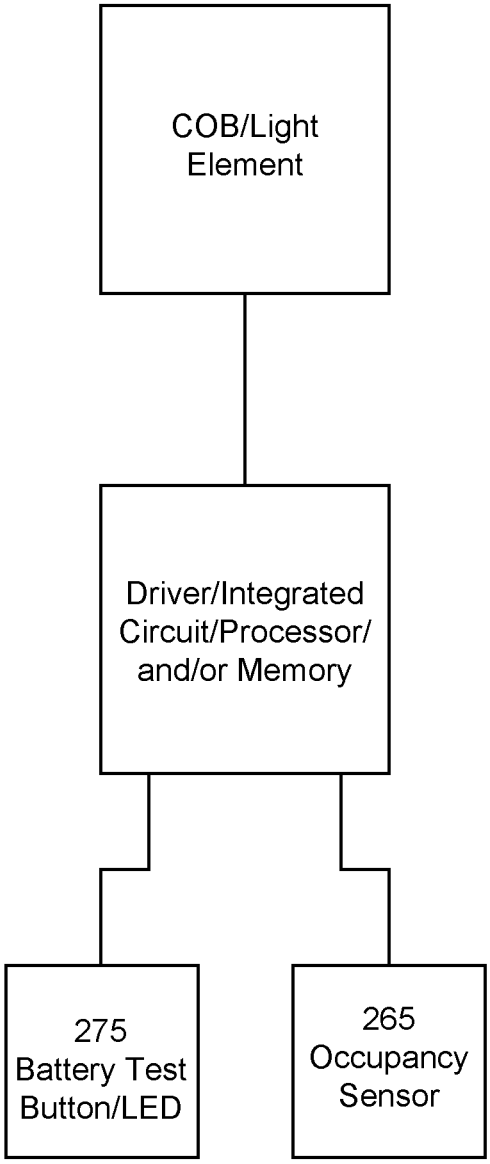
FIG. 36 is a schematic view of the electronics of the wall pack light fixture of FIG. 21.

In some embodiments, the wall pack light fixture 500 includes at least one chip-on-board (COB) 380/385/390 (see FIG. 34). In some embodiments, the COB includes at least one light emitting diode (LED) for producing light. In some embodiments, the COB includes multiple LEDs. For example, in some embodiments, the wall pack includes three (3) COBs. In other embodiments, and in addition to and/or alternatively, the wall pack can include lighting elements other than a COB. For example, the wall pack can include lighting elements and circuitry for incandescent lighting, halogen lighting, AC/DC converters, transformers, etc. In addition, the wall pack can include electronics to control the lighting elements, for example, a processor, integrated circuit, and/or memory. See FIG. 36. In some embodiments, the fixture includes an aperture 145 defined in the front cover 105, a reflector (see FIG. 34), and a transparent cover 150 mounted between the lighting, such as the LEDs, and the outside environment. In some embodiments, the transparent cover 150 is made of glass. In some embodiments, the transparent cover 150 is made of plastic. The transparent cover 150 is not limited to any particular transparent material. In some alternative embodiments, the transparent cover 150 is translucent.

Figure 6:
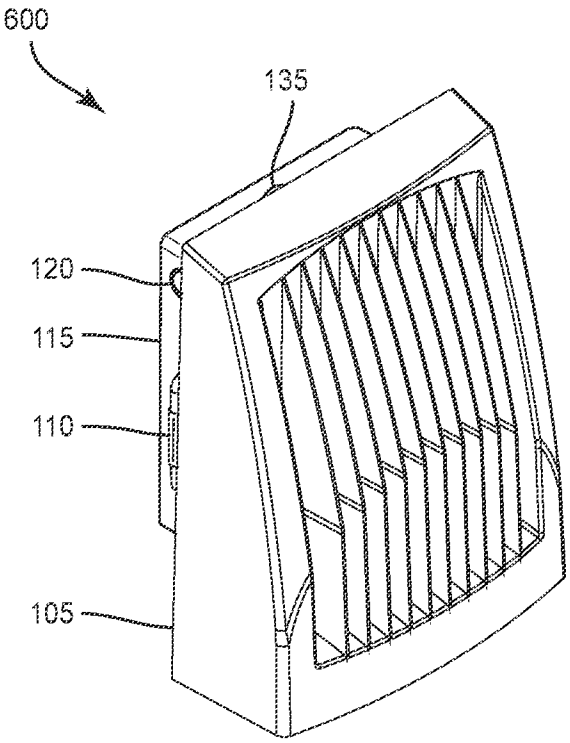
FIG. 6 is a left side, elevated front perspective view of an exemplary embodiment of wall pack light fixture according to the present disclosure.

Referring to FIG. 6, a left side, elevated front perspective view of an exemplary embodiment of wall pack light fixture 600 according to the present disclosure is shown. The wall pack light fixture 600 includes the front cover 105 movably attached by the hinge 110 to the rear enclosure 115 to permit access to the interior of the wall pack light fixture 600 formed by the front cover, hinge and rear enclosure. In some embodiments, the wall pack light fixture 600 includes the left side access aperture 120 and the top access aperture 135.

Figure 7:
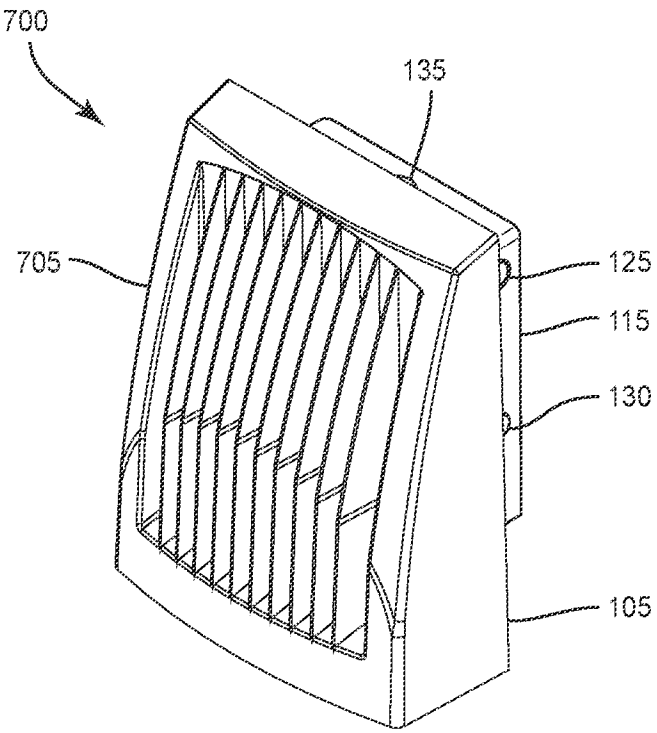
FIG. 7 is a right side, elevated front perspective view of an exemplary embodiment of wall pack light fixture according to the present disclosure.

Referring to FIG. 7, a right side, elevated front perspective view of an exemplary embodiment of wall pack light fixture according to the present disclosure is shown. The wall pack light fixture 700 includes the front cover 105 movably attached by the hinge 110 (not shown here) to the rear enclosure 115 to permit access to the interior of the wall pack light fixture 700 formed by the front cover, hinge and rear enclosure. In some embodiments, the wall pack light fixture 700 includes the right side access aperture 125, the top access aperture 135 and the latch 130.

Figure 8:
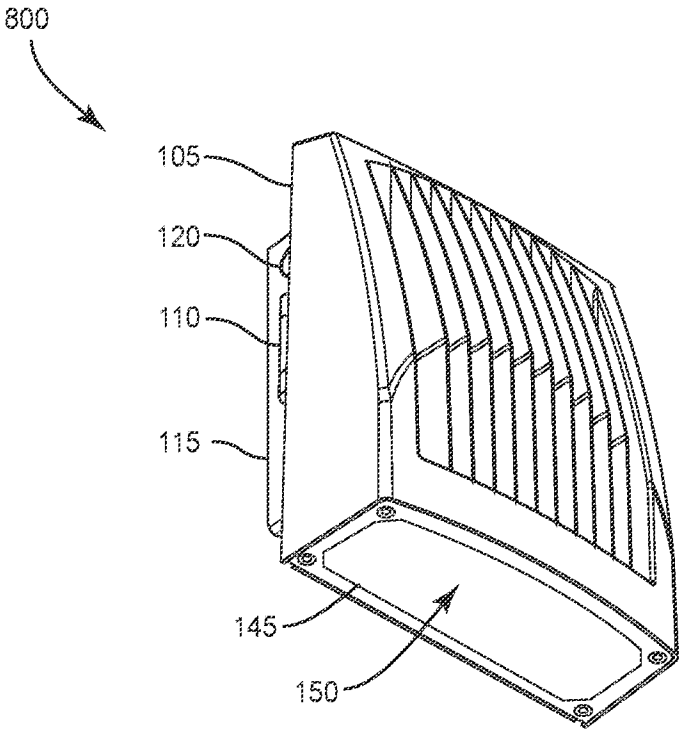
FIG. 8 is a left side, lowered front perspective view of an exemplary embodiment of wall pack light fixture according to the present disclosure.

Referring to FIG. 8, a left side, lowered front perspective view of an exemplary embodiment of wall pack light fixture 800 according to the present disclosure is shown. The wall pack light fixture 800 includes the front cover 105 movably attached by the hinge 110 to the rear enclosure 115 to permit access to the interior of the wall pack light fixture 800 formed by the front cover, hinge and rear enclosure. In some embodiments, the wall pack light fixture 800 includes the left side access aperture 120, the aperture 145 and the transparent cover 150.

Figure 9:
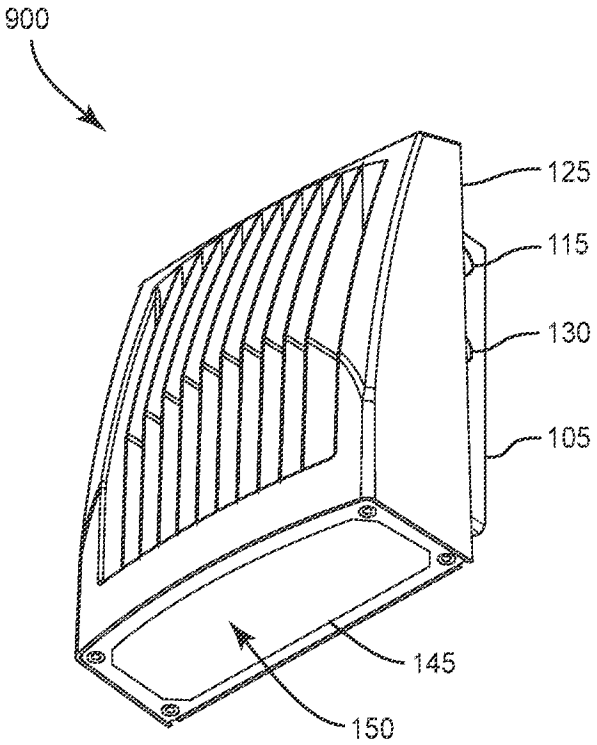
FIG. 9 is a right side, lowered front perspective view of an exemplary embodiment of wall pack light fixture according to the present disclosure.

Referring to FIG. 9, a right side, lowered front perspective view of an exemplary embodiment of wall pack light fixture 900 according to the present disclosure is shown. The wall pack light fixture 900 includes the front cover 105 movably attached by the hinge 110 (not shown here) to the rear enclosure 115 to permit access to the interior of the wall pack light fixture 700 formed by the front cover, hinge and rear enclosure. In some embodiments, the wall pack light fixture 900 includes the right side access aperture 125, the aperture 145, the transparent cover 150 and the latch 130.

Figure 10:
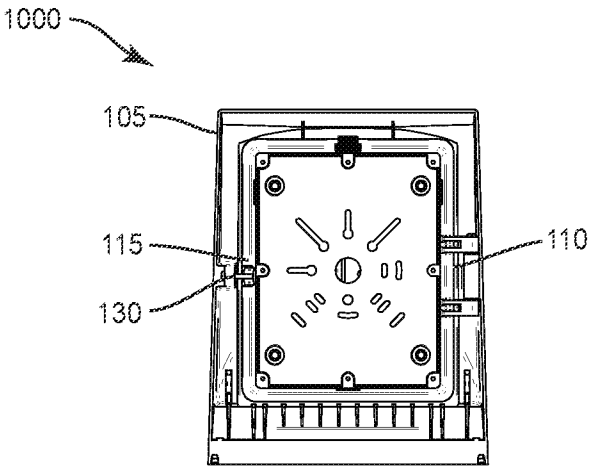
FIG. 10 is a back plan view of an exemplary embodiment of wall pack light fixture according to the present disclosure.

Referring to FIG. 10, a back plan view of an exemplary embodiment of wall pack light fixture 1000 according to the present disclosure is shown. The wall pack light fixture 1000 includes the front cover 105 movably attached by the hinge 110 to the rear enclosure 115 to permit access to the interior of the wall pack light fixture 1000 formed by the front cover, hinge and rear enclosure. In some embodiments, the wall pack light fixture 1000 includes the latch 130. In some embodiments, as shown in FIG. 10, the rear enclosure 115 contains one or more holes and slots for receiving mounting devices such as screws, bolts and nails.

Figure 11:
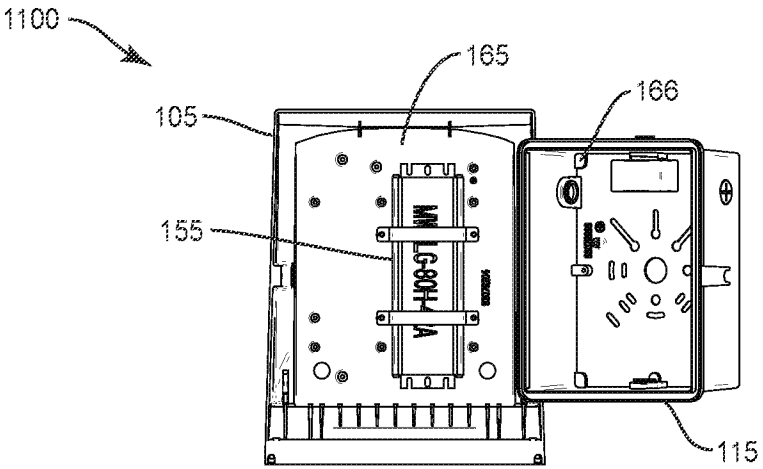
FIG. 11 is a back plan view of an exemplary embodiment of wall pack light fixture having an open rear enclosure in perspective view according to the present disclosure.

Referring to FIG. 11, a back plan view of an exemplary embodiment of wall pack light fixture having an open rear enclosure in perspective view according to the present disclosure is shown. The wall pack light fixture 1000 includes the front cover 105 movably attached by the hinge 110 to the rear enclosure 115 to permit access to the interior of the wall pack light fixture 1000 formed by the front cover, hinge and rear enclosure. In some embodiments, the wall pack light fixture 1000 includes a driver 155 mounted on a front cover contact surface 165. In some embodiments, the driver 155 supplies power to the COB. The front facing edge 166 can include deformable and/or resilient material for enhancing the seal between front cover contact surface 165 and the front facing edge 166. For example, the front facing edge 166 can include rubber, foam, compressible tubing and the like for enhancing a weatherproof seal. Therefore, an enhanced weatherproof enclosure is provided, because the front cover 105 can extend over and surround rear enclosure 115, the hinge 110 can provide uniform contact and a seal can be formed where the front cover contact surface 165 meets the front facing edge 166.

FIG. 11 is similar to that of FIG. 10, however, in FIG. 10 the rear enclosure 115 is closed against the front cover 105 in FIG. 10, thereby forming and protecting the interior. In FIG. 11, in contrast, the rear enclosure 115 is separated from the front cover 105 while still being connected by the hinge 110.

Figure 12:
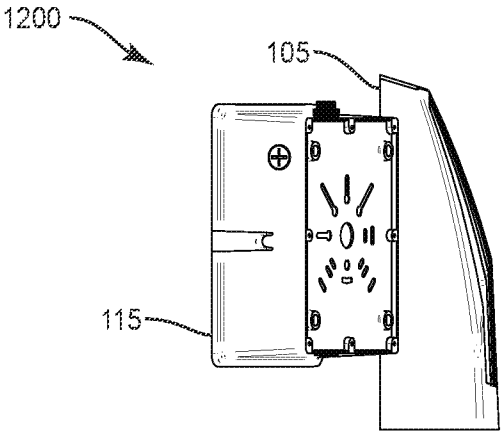
FIG. 12 is a left side plan view of an exemplary embodiment of wall pack light fixture having an open rear enclosure in perspective view according to the present disclosure.

Referring to FIG. 12, a left side plan view of an exemplary embodiment of wall pack light fixture 1200 having an open rear enclosure in perspective view according to the present disclosure is shown. The wall pack light fixture 1200 includes the front cover 105 movably attached by the hinge 110 to the rear enclosure 115 to permit access to the interior of the wall pack light fixture 1000 formed by the front cover, hinge and rear enclosure.

Figure 13:
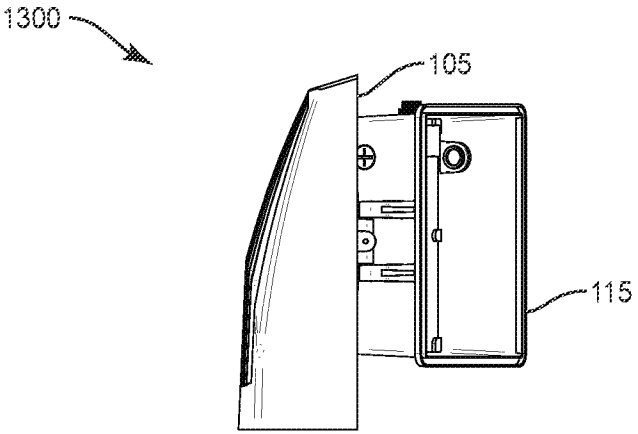
FIG. 13 is a right side plan view of an exemplary embodiment of wall pack light fixture having an open rear enclosure in perspective view according to the present disclosure.

Referring to FIG. 13, a right side plan view of an exemplary embodiment of wall pack light fixture 1300 having an open rear enclosure in perspective view according to the present disclosure is shown. The wall pack light fixture 1300 includes the front cover 105 movably attached by the hinge 110 to the rear enclosure 115 to permit access to the interior of the wall pack light fixture 1000 formed by the front cover, hinge and rear enclosure.

Figure 14:
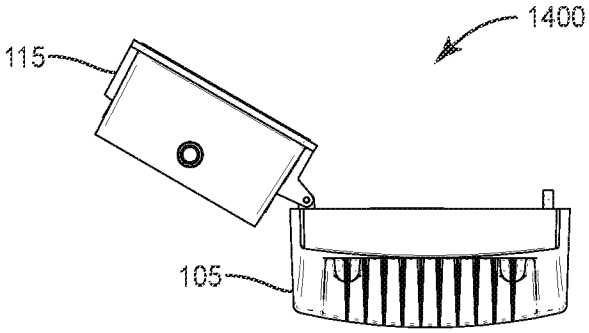
FIG. 14 is a top plan view of an exemplary embodiment of wall pack light fixture having an open rear enclosure in perspective view according to the present disclosure.

Referring to FIG. 14, a top plan view of an exemplary embodiment of wall pack light fixture having an open rear enclosure in perspective view according to the present disclosure is shown. The wall pack light fixture 1400 includes the front cover 105 movably attached by the hinge 110 to the rear enclosure 115 to permit access to the interior of the wall pack light fixture 1000 formed by the front cover, hinge and rear enclosure.

Figure 15:
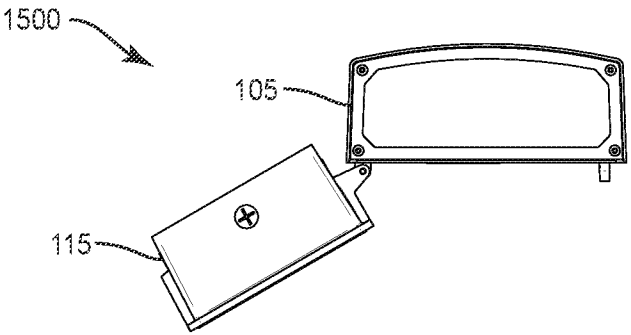
FIG. 15 is a bottom plan view of an exemplary embodiment of wall pack light fixture having an open rear enclosure in perspective view according to the present disclosure.

Referring to FIG. 15, a bottom plan view of an exemplary embodiment of wall pack light fixture having an open rear enclosure in perspective view according to the present disclosure is shown. The wall pack light fixture 1500 includes the front cover 105 movably attached by the hinge 110 to the rear enclosure 115 to permit access to the interior of the wall pack light fixture 1000 formed by the front cover, hinge and rear enclosure.

Figure 16:
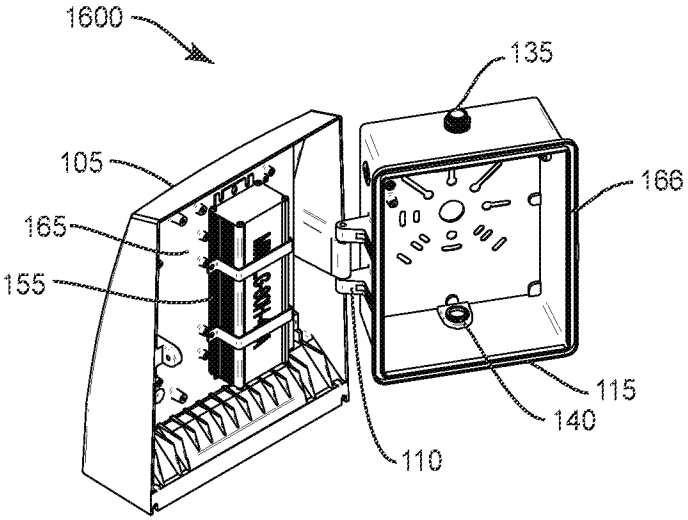
FIG. 16 is a right side, elevated back perspective view of an exemplary embodiment of wall pack light fixture according to the present disclosure.

Referring to FIG. 16, a right side, elevated back perspective view of an exemplary embodiment of wall pack light fixture according to the present disclosure is shown. The wall pack light fixture 1500 includes the front cover 105 movably attached by the hinge 110 to the rear enclosure 115 to permit access to the interior of the wall pack light fixture 1500 formed by the front cover, hinge and rear enclosure. In some embodiments, the wall pack light fixture 1600 includes the top access aperture 135, and the bottom access aperture 140.

Figure 17:
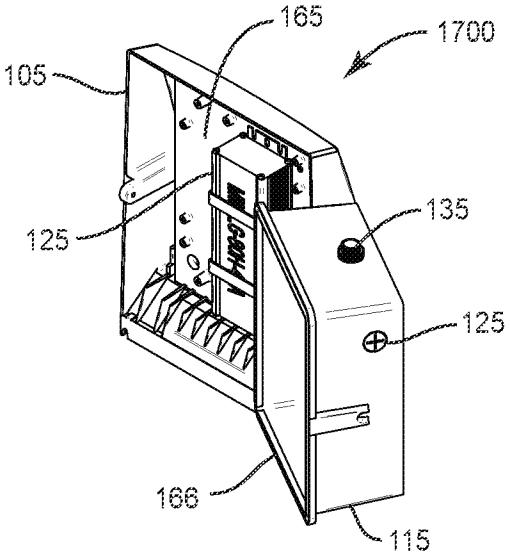
FIG. 17 is a left side, elevated back perspective view of an exemplary embodiment of wall pack light fixture according to the present disclosure.

Referring to FIG. 17, a left side, elevated back perspective view of an exemplary embodiment of wall pack light fixture according to the present disclosure is shown. The wall pack light fixture 1700 includes the front cover 105 movably attached by the hinge 110 to the rear enclosure 115 to permit access to the interior of the wall pack light fixture 1700 formed by the front cover, hinge and rear enclosure. In some embodiments, the wall pack light fixture 1700 includes the top access aperture 135, and right side access aperture 125.

Figure 18:
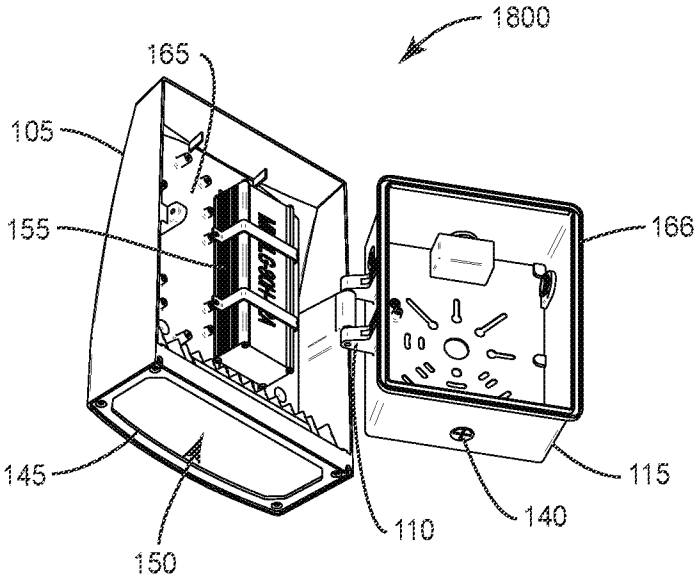
FIG. 18 is a right side, lowered back perspective view of an exemplary embodiment of wall pack light fixture according to the present disclosure.

Referring to FIG. 18, a right side, lowered back perspective view of an exemplary embodiment of wall pack light fixture 1800 according to the present disclosure is shown. The wall pack light fixture 1800 includes the front cover 105 movably attached by the hinge 110 to the rear enclosure 115 to permit access to the interior of the wall pack light fixture 1800 formed by the front cover, hinge and rear enclosure. In some embodiments, the wall pack light fixture 1800 includes the bottom access aperture 140, the aperture 145, and the transparent cover 150.

Figure 19:
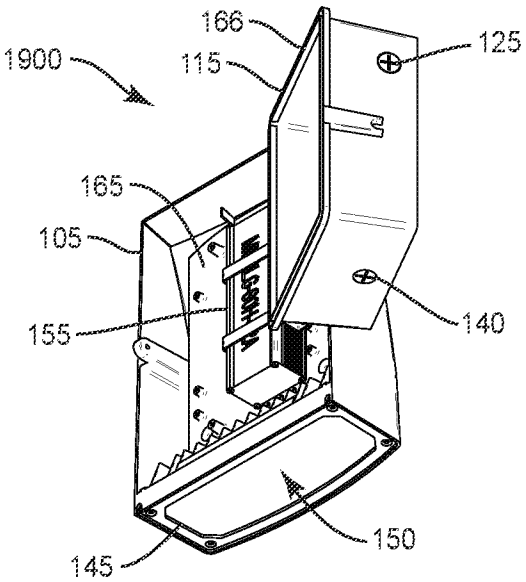
FIG. 19 is a left side, lowered back perspective view of an exemplary embodiment of wall pack light fixture according to the present disclosure.

Referring to FIG. 19, a left side, lowered back perspective view of an exemplary embodiment of wall pack light fixture 1900 according to the present disclosure is shown. The wall pack light fixture 1900 includes the front cover 105 movably attached by the hinge 110 to the rear enclosure 115 to permit access to the interior of the wall pack light fixture 1900 formed by the front cover, hinge and rear enclosure. In some embodiments, the wall pack light fixture 1900 includes the bottom access aperture 140, the right side access aperture 125, the aperture 145 and the transparent cover 150.

Figure 20:
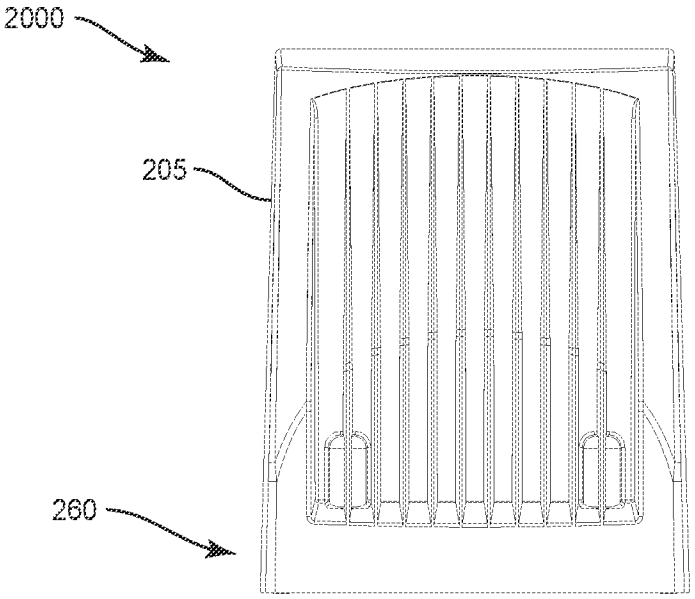
FIG. 20 is a front plan view of an additional exemplary embodiment of wall pack light fixture according to the present disclosure.
Figure 21:
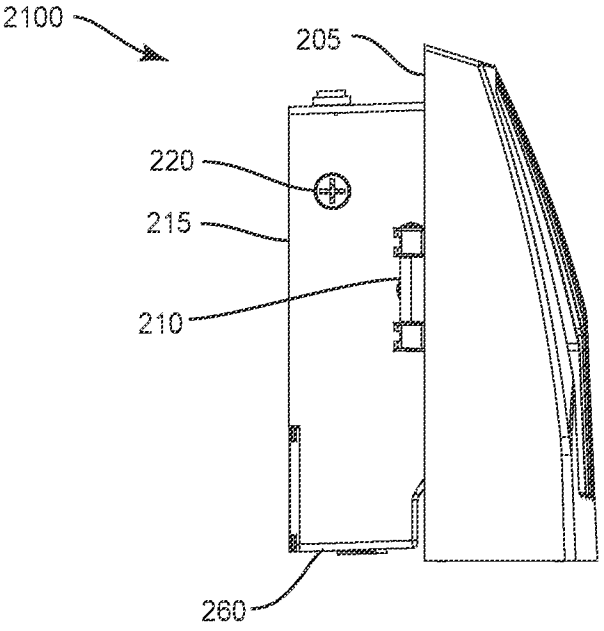
FIG. 21 is a left side plan view of an additional exemplary embodiment of wall pack light fixture according to the present disclosure.

Referring to FIG. 20, a front plan view of an additional exemplary embodiment of wall pack light fixture 2000 according to the present disclosure is shown. The wall pack light fixture 2000 includes a front cover 205. Referring briefly to FIG. 21, the front cover 205 is movably attached by a hinge 210 to a rear enclosure 215 to permit access to an interior of the wall pack light fixture 2000 formed by the front cover, hinge and rear enclosure. Returning to FIG. 20, in some embodiments, the front cover 205 includes vertical fins, also known as ribs. In some embodiments, the vertical fins are for heat dissipation, while in other embodiments the vertical fins are decorative. In some embodiments, the front cover is made of materials suitable for direct exposure to outside conditions that include one or more of fresh water, salt water, temperature extremes, sunlight, animals, dust, debris, corrosive chemicals, combustible materials and explosive materials. In some embodiments, the front cover substantially protects the interior from at least one such outside condition. In some embodiments, the front cover 205 is made from die cast aluminum, although the front cover is not limited to any particular metal or material. In some embodiments, the front cover 205 is coated with a polyester powder applied with a static charge.

In some embodiments, the rear enclosure 215 includes an expanded section 260 positioned towards the bottom of the rear enclosure. The expanded section 260 includes an occupancy sensor and battery backup as described herein, and/or other components.

Referring to FIG. 21, a left side plan view of an additional exemplary embodiment of wall pack light fixture 2100 according to the present disclosure is shown. The wall pack light fixture 2100 includes the front cover 205 movably attached by the hinge 210 to the rear enclosure 215 to permit access to the interior of the wall pack light fixture 2100 formed by the front cover, hinge and rear enclosure. In some embodiments, the hinge 210 is made of materials suitable for direct exposure to outside conditions that include one or more of fresh water, salt water, temperature extremes, sunlight, animals, dust, debris, corrosive chemicals, combustible materials and explosive materials. In some embodiments, the hinge 210 substantially protects the interior from at least one such outside condition. In some embodiments, the hinge 210 is made from die cast aluminum, although the hinge is not limited to any particular metal or material. In some embodiments, the hinge 210 is coated on exterior portions, so as not to interfere with hinge movement, with a polyester powder applied with a static charge.

In some embodiments, the rear enclosure 215 is made of materials suitable for direct exposure to outside conditions that include one or more of fresh water, salt water, temperature extremes, sunlight, animals, dust, debris, corrosive chemicals, combustible materials and explosive materials. In some embodiments, rear enclosure 215 substantially protects the interior from at least one such outside condition. In some embodiments, the rear enclosure 215 is made from die cast aluminum, although the rear enclosure is not limited to any particular metal or material. In some embodiments, the rear enclosure 215 is coated with a polyester powder applied with a static charge. In preferred embodiments of the invention, the front cover 205 fits over the rear enclosure 215 to help shelter the interior of the rear enclosure 215.

In some embodiments, the wall pack light fixture 2100 includes a left side access aperture 220. In some embodiments, the left side access aperture 220 enables access to the interior. In some embodiments, the left side access aperture 220 enables mounting at least one of a light sensor, a switch and an electrical cable, depending on desired application for the wall pack light fixture. In some embodiments, the left side access aperture 220 is closed with a flush screw. In some embodiments, the left side access aperture 220 is closed with a recessed screw.

In some embodiments, the expanded section 260 in the rear enclosure 215 is positioned towards the bottom of the rear enclosure. The expanded section 260 includes an occupancy sensor and battery backup as described herein.

Figure 22:
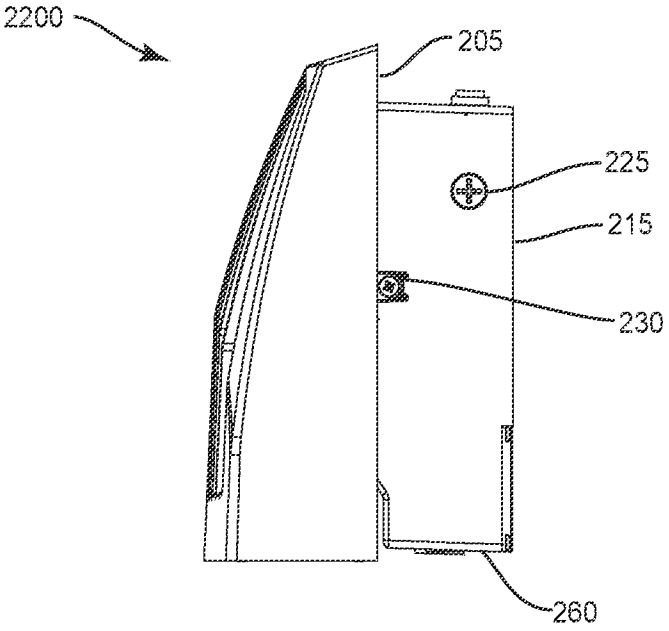
FIG. 22 is a right side plan view of an additional exemplary embodiment of wall pack light fixture according to the present disclosure.

Referring to FIG. 22, a right side plan view of an additional exemplary embodiment of wall pack light fixture 2200 according to the present disclosure is shown. The wall pack light fixture 2200 includes the front cover 205 movably attached by the hinge 210 (not shown here) to the rear enclosure 215 to permit access to the interior of the wall pack light fixture 2200 formed by the front cover, hinge and rear enclosure.

In some embodiments, the wall pack light fixture 2200 includes a right side access aperture 225. In some embodiments, the right side access aperture 225 enables access to the interior. In some embodiments, the right side access aperture 225 enables mounting at least one of a light sensor, a switch and an electrical cable, depending on desired application for the wall pack light fixture. In some embodiments, the right side access aperture 225 is closed with a flush screw. In some embodiments, the right side access aperture 225 is closed with a recessed screw.

In some embodiments, the wall pack light fixture 2200 includes a latch 230. In some embodiments, the latch 230 includes a closing screw used to hold the rear enclosure closed by threading through both a portion of the rear enclosure 215 and the front cover 205.

In some embodiments, the expanded section 260 in the rear enclosure 215 is positioned towards the bottom of the rear enclosure. The expanded section 260 includes an occupancy sensor and battery backup as described herein.

Figure 23:
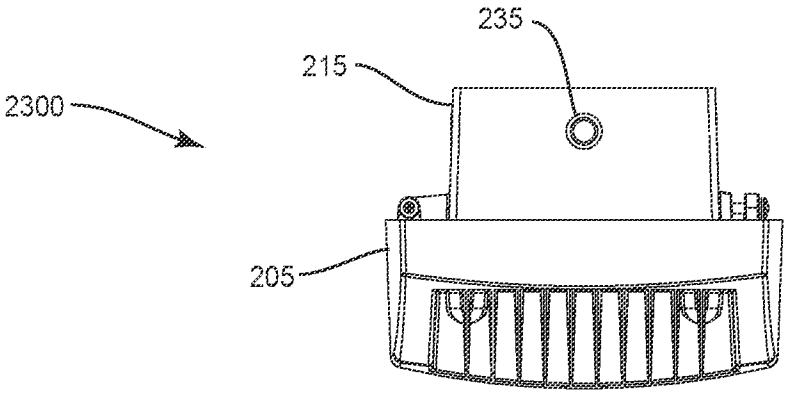
FIG. 23 is a top plan view of an additional exemplary embodiment of wall pack light fixture according to the present disclosure.

Referring to FIG. 23, a top plan view of an additional exemplary embodiment of wall pack light fixture 2300 according to the present disclosure is shown. The wall pack light fixture 2300 includes the front cover 205 movably attached by the hinge 210 (not shown here) to the rear enclosure 215 to permit access to the interior of the wall pack light fixture 2300 formed by the front cover, hinge and rear enclosure.

In some embodiments, the wall pack light fixture 2300 includes a top access aperture 235. In some embodiments, the top access aperture 235 enables access to the interior. In some embodiments, the top access aperture 235 enables mounting at least one of a light sensor, a switch and an electrical cable, depending on desired application for the wall pack light fixture 2300. In some embodiments, the top access aperture 235 is closed with a flush screw. In some embodiments, the top access aperture 235 is closed with a recessed screw.

Figure 24:
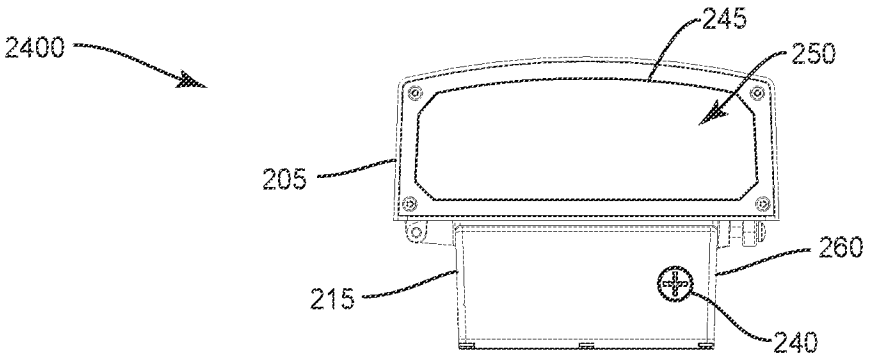
FIG. 24 is a bottom plan view of an additional exemplary embodiment of wall pack light fixture according to the present disclosure.

Referring to FIG. 24, a bottom plan view of an additional exemplary embodiment of wall pack light fixture 2400 according to the present disclosure is shown. The wall pack light fixture 2400 includes the front cover 205 movably attached by the hinge 210 (not shown here) to the rear enclosure 215 to permit access to the interior of the wall pack light fixture 500 formed by the front cover, hinge and rear enclosure. In some embodiments, the wall pack light fixture 2400 includes a bottom access aperture 240 for mounting at least one a light sensor, a switch and an electrical cable, depending on desired application. In some embodiments, the bottom access aperture 225 is closed with a flush screw. In some embodiments, the bottom access aperture 225 is closed with a recessed screw.

In some embodiments, the wall pack light fixture 2400 includes a bottom access aperture 240. In some embodiments, the bottom access aperture 240 enables access to the interior. In some embodiments, the bottom access aperture 240 enables mounting at least one of a light sensor, a switch and an electrical cable, depending on desired application for the wall pack light fixture. In some embodiments, the bottom access aperture 240 is closed with a flush screw. In some embodiments, the bottom access aperture 240 is closed with a recessed screw.

In some embodiments, the wall pack light fixture 2400 includes aperture 245. In some embodiments, the aperture 245 includes lighting having at least one light emitting diode (LED) for producing light. In some embodiments, the aperture 245 includes multiple LEDs. For example, in some embodiments, the aperture 245 includes three (3) LEDs. In some alternative embodiments, the aperture 245 includes lighting having incandescent lighting. In some alternative embodiments, the aperture 245 includes lighting having halogen lighting. The fixture is not limited to any particular form of lighting. In some embodiments, the aperture 245 contains circuitry for powering and controlling lighting (not shown here). In some embodiments, the circuitry converts alternating current (AC) voltage received from an electrical grid into direct current (DC) voltage compatible with at least one LED. In some embodiments, the circuitry changes the voltage level received from the electrical grid to a voltage level compatible with the lighting. In some embodiments, the aperture 245 includes a transparent cover 250 mounted between the lighting, such as the LEDs, and the outside environment. In some embodiments, the transparent cover 250 is made of glass. In some embodiments, the transparent cover 250 is made of plastic. The transparent cover 250 is not limited to any particular transparent material. In some alternative embodiments, the transparent cover 250 is translucent.

In some embodiments, the expanded section 260 in the rear enclosure 215 is positioned towards the bottom of the rear enclosure. The expanded section 260 includes an occupancy sensor and battery backup as described herein.

Figure 25:
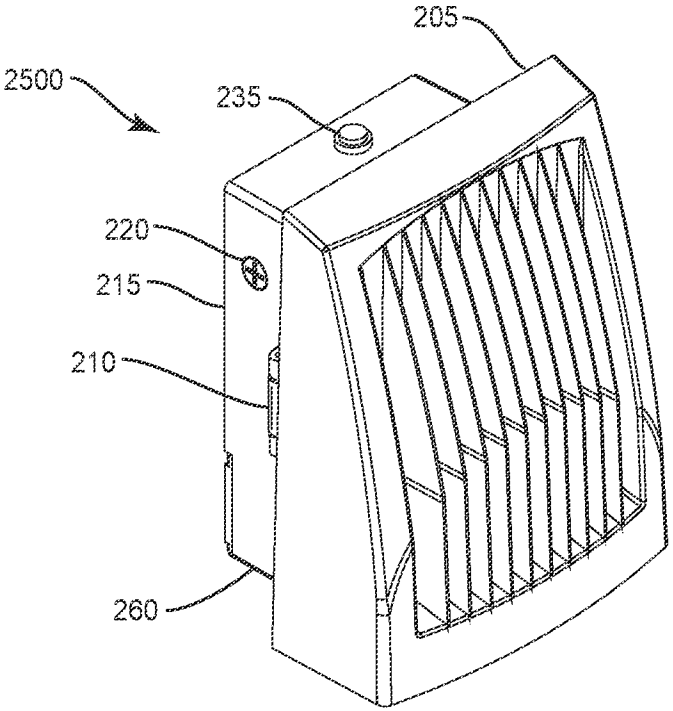
FIG. 25 is a left side, elevated front perspective view of an additional exemplary embodiment of wall pack light fixture according to the present disclosure.

Referring to FIG. 25, a left side, elevated front perspective view of an additional exemplary embodiment of wall pack light fixture 2500 according to the present disclosure is shown. The wall pack light fixture 2500 includes the front cover 205 movably attached by the hinge 210 to the rear enclosure 215 to permit access to the interior of the wall pack light fixture 2500 formed by the front cover, hinge and rear enclosure. In some embodiments, the wall pack light fixture 2500 includes the left side access aperture 220 and the top access aperture 235.

In some embodiments, the expanded section 260 in the rear enclosure 215 is positioned towards the bottom of the rear enclosure. The expanded section 260 includes an occupancy sensor and battery backup as described herein.

Figure 26:
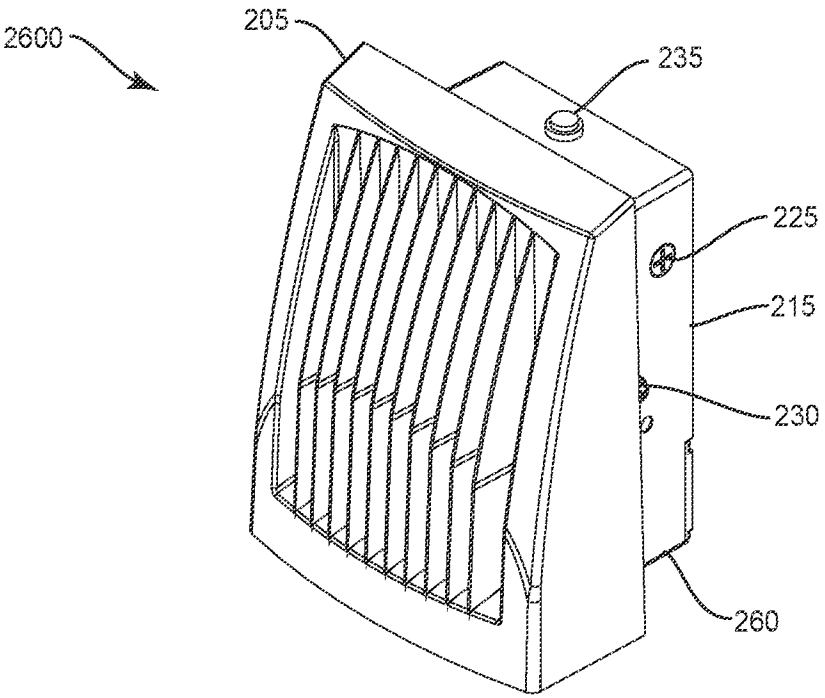
FIG. 26 is a right side, elevated front perspective view of an additional exemplary embodiment of wall pack light fixture according to the present disclosure.

Referring to FIG. 26, a right side, elevated front perspective view of an additional exemplary embodiment of wall pack light fixture 2600 according to the present disclosure is shown. The wall pack light fixture 2600 includes the front cover 205 movably attached by the hinge 210 (not shown here) to the rear enclosure 215 to permit access to the interior of the wall pack light fixture 2600 formed by the front cover, hinge and rear enclosure. In some embodiments, the wall pack light fixture 2600 includes the right side access aperture 225, the top access aperture 235 and the latch 230.

In some embodiments, the expanded section 260 in the rear enclosure 215 is positioned towards the bottom of the rear enclosure. The expanded section 260 includes an occupancy sensor and battery backup as described herein.

Figure 27:
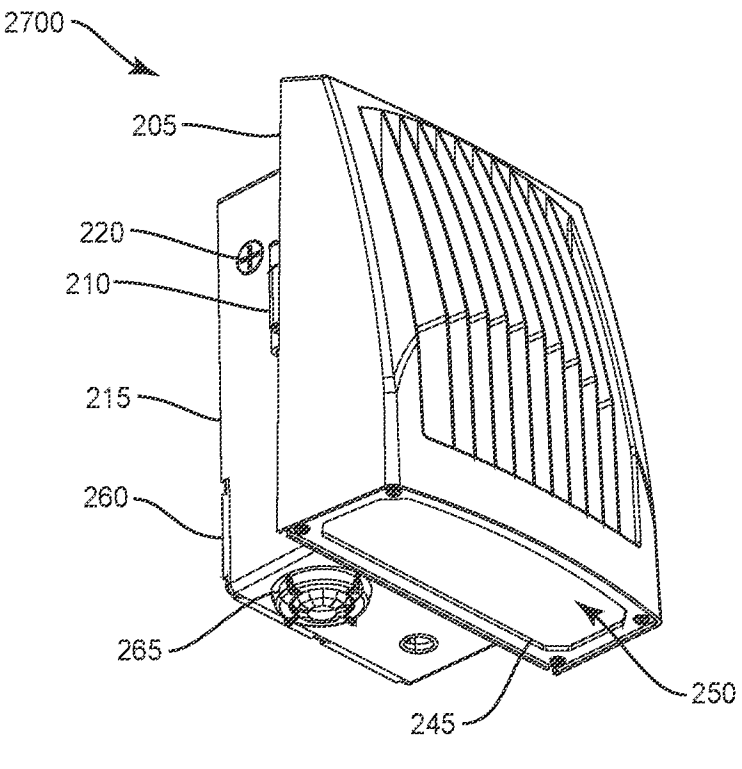
FIG. 27 is a left side, lowered front perspective view of an additional exemplary embodiment of wall pack light fixture according to the present disclosure.

Referring to FIG. 27, a left side, lowered front perspective view of an additional exemplary embodiment of wall pack light fixture 2700 according to the present disclosure is shown. The wall pack light fixture 2700 includes the front cover 205 movably attached by the hinge 210 to the rear enclosure 215 to permit access to the interior of the wall pack light fixture 2700 formed by the front cover, hinge and rear enclosure. In some embodiments, the wall pack light fixture 2700 includes the left side access aperture 220, the aperture 245 and the transparent cover 250.

In some embodiments, the expanded section 260 in the rear enclosure 215 is positioned towards the bottom of the rear enclosure. The expanded section 260 includes an occupancy sensor 265 and battery backup as described herein. In some embodiments, the occupancy sensor 265 detects infrared light in a certain field of view to control the COB. The COB (not shown) is the same as the COB 380/385/390 described herein. In some embodiments, if the occupancy sensor 265 detects infrared light, the COB infers the presence of people or similarly warm objects such as animals, and activates the light. In some embodiments, after a period of time has elapsed without the detection of infrared light, the COB infers the absence of people or similarly warm objects such as animals, and deactivates the COB. In some alternative embodiments, the occupancy sensor 265 enables motion detection by the COB by comparing different video frames received from the occupancy sensor. In some alternative embodiments, the occupancy sensor 265 enables motion detection by using non-recording video. In some embodiments, the occupancy sensor 265 has an adjustable sensitivity level. Other known types and systems for detecting the presence of a person or moving object are contemplated.

In some embodiments, the expanded section 260 includes a battery backup adapted to power the wall pack light fixture 2700 to provide light from the COB. In some embodiments, the battery backup provides power for lighting in lieu of a primary electrical power source, such as when primary power is lost. The battery backup is controlled by the COB.

Figure 28:
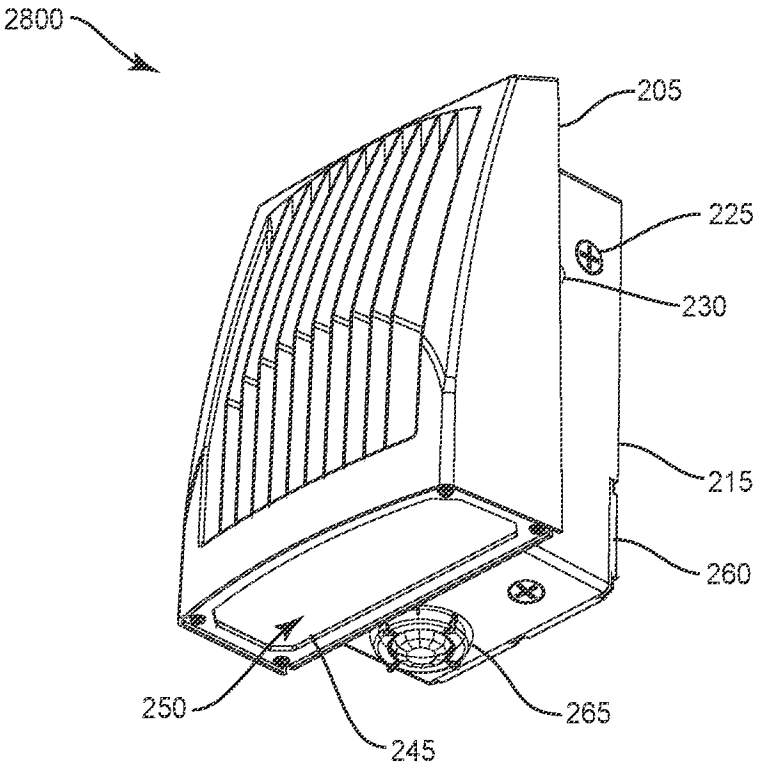
FIG. 28 is a right side, lowered front perspective view of an additional exemplary embodiment of wall pack light fixture according to the present disclosure.

Referring to FIG. 28, a right side, lowered front perspective view of an additional exemplary embodiment of wall pack light fixture 2800 according to the present disclosure is shown. The wall pack light fixture 2800 includes the front cover 205 movably attached by the hinge 210 (not shown here) to the rear enclosure 215 to permit access to the interior of the wall pack light fixture 2800 formed by the front cover, hinge and rear enclosure. In some embodiments, the wall pack light fixture 2800 includes the right side access aperture 225, the aperture 245, the transparent cover 250 and the latch 230.

Figure 29:
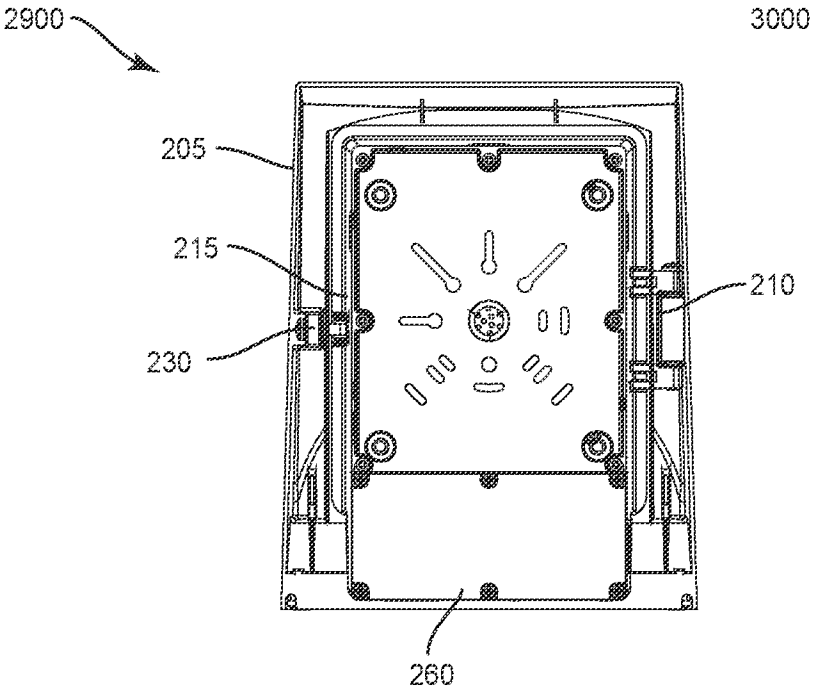
FIG. 29 is a back plan view of an additional exemplary embodiment of wall pack light fixture according to the present disclosure.

Referring to FIG. 29, a back plan view of an additional exemplary embodiment of wall pack light fixture 2900 according to the present disclosure is shown. The wall pack light fixture 2900 includes the front cover 205 movably attached by the hinge 210 to the rear enclosure 215 to permit access to the interior of the wall pack light fixture 2900 formed by the front cover, hinge and rear enclosure. In some embodiments, the wall pack light fixture 2900 includes the latch 230 and the expanded section 260. In some embodiments, as shown in FIG. 29, the rear enclosure 215 contains one or more holes and slots for receiving mounting devices such as screws, bolts and nails.

Figure 30:
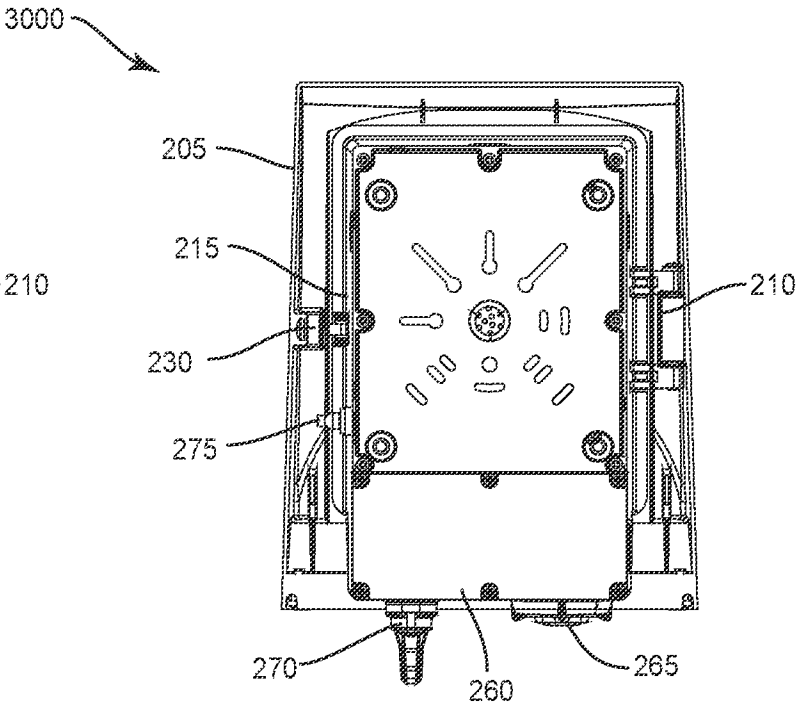
FIG. 30 is a back plan view of an additional exemplary embodiment of wall pack light fixture having an open rear enclosure in perspective view according to the present disclosure.

Referring to FIG. 30, a back plan view of an another exemplary embodiment of wall pack light fixture 3000 according to the present disclosure is shown. The wall pack light fixture 3000 includes the front cover 205 movably attached by the hinge 210 to the rear enclosure 215 to permit access to the interior of the wall pack light fixture 2900 formed by the front cover, hinge and rear enclosure. In some embodiments, the wall pack light fixture 2900 includes the latch 230, the expanded section 260 and the occupancy sensor 265. In some embodiments, as shown in FIG. 29, the rear enclosure 215 contains one or more holes and slots for receiving mounting devices such as screws, bolts and nails.

The wall pack light fixtures 2000 through 3000 can include the front cover contact surface 165 in the front cover 205; and the front facing edge 166 on the rear enclosure 215.

In some embodiments, the wall pack light fixture 3000 includes an electrical connector 270 for providing connectivity to the internal electronics. In some embodiments, the wall pack light fixture 3000 includes a battery backup test button 275 for enabling manual activation of a test of the battery backup. In some embodiments, if the battery backup is insufficiently charged, a warning light indicates failure of the battery backup test. In some embodiments, if the battery backup is sufficiently charged, a passing light indicates passing of the battery backup test. In some embodiments, a single LED acts as both the warning light by flashing and as the passing light by being continuous.

Figure 31:
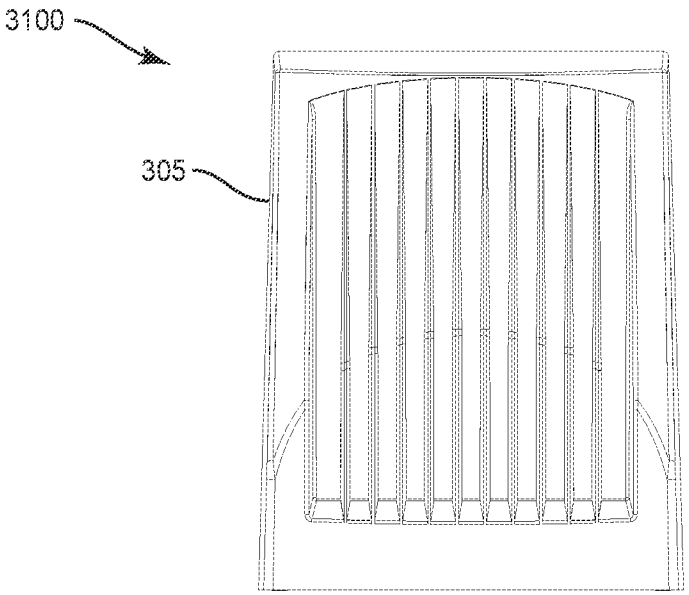
FIG. 31 is a front view of an exemplary embodiment of wall pack light fixture according to the present disclosure.

Referring to FIG. 31, a front view of an exemplary embodiment of wall pack light fixture 3100 according to the present disclosure is shown. The wall pack light fixture 3100 includes a front cover 305 movably attached by a hinge 310 (not shown here) to the rear enclosure 315 (not shown here) to permit access to the interior of the wall pack light fixture 3100 formed by the front cover, hinge and rear enclosure.

Figure 32:
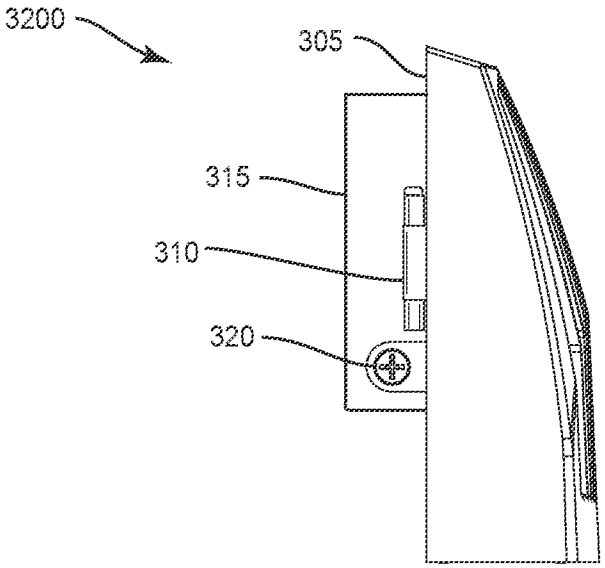
FIG. 32 is a left side view of an exemplary embodiment of wall pack light fixture according to the present disclosure.

Referring to FIG. 32, a left side view of an exemplary embodiment of wall pack light fixture 3200 according to the present disclosure is shown. The wall pack light fixture 3200 includes the front cover 305 movably attached by the hinge 310 to the rear enclosure 315 to permit access to the interior of the wall pack light fixture 3100 formed by the front cover, hinge and rear enclosure. The front cover 305 can include the front cover contact surface 165, which will receive contact from the front facing edge 166 of the rear enclosure 315.

Figure 33:
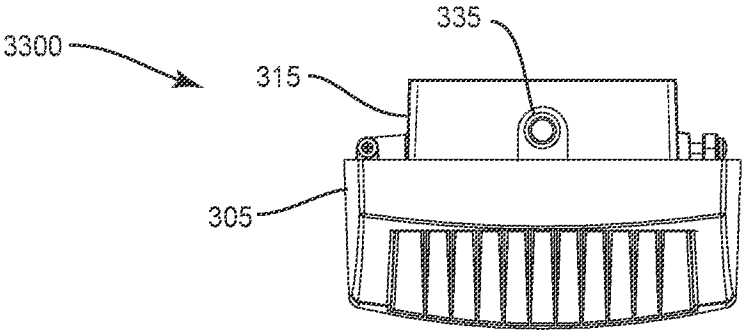
FIG. 33 is a top view of an exemplary embodiment of wall pack light fixture according to the present disclosure.

Referring to FIG. 33, a top view of an exemplary embodiment of wall pack light fixture 3300 according to the present disclosure is shown. The wall pack light fixture 3300 includes the front cover 305 movably attached by the hinge 310 (not shown here) to the rear enclosure 315 to permit access to the interior of the wall pack light fixture 3100 formed by the front cover, hinge and rear enclosure.

In some embodiments, the wall pack light fixture 3300 includes a top access aperture 335. In some embodiments, the top access aperture 335 enables access to the interior. In some embodiments, the top access aperture 335 enables mounting at least one of a light sensor, a switch and an electrical cable, depending on desired application for the wall pack light fixture 3300. In some embodiments, the top access aperture 335 is closed with a flush screw. In some embodiments, the top access aperture 335 is closed with a recessed screw.

Referring to FIG. 34, a bottom plan view of an exemplary embodiment of wall pack light fixture 3400 according to the present disclosure is shown. The wall pack light fixture 3400 includes the front cover 305 movably attached by the hinge 310 (not shown here) to the rear enclosure 315 to permit access to the interior of the wall pack light fixture 3400 formed by the front cover, hinge and rear enclosure.

In some embodiments, the wall pack light fixture 3400 includes an aperture 345. In some embodiments, the aperture 345 includes lighting having at least one light emitting diode (LED) for producing light. In some embodiments, the aperture 345 includes multiple LEDs. For example, in some embodiments, the aperture 345 includes a first COB/LED 380, a second COB/LED 385 and a third COB/LED 390. In some alternative embodiments, the aperture 345 includes lighting having incandescent lighting. In some alternative embodiments, the aperture 345 includes lighting having halogen lighting. The fixture is not limited to any particular form of lighting. In some embodiments, the aperture 345 contains circuitry for powering and controlling lighting (not shown here). In some embodiments, the circuitry converts alternating current (AC) voltage received from an electrical grid into direct current (DC) voltage compatible with at least one LED. In some embodiments, the circuitry changes the voltage level received from the electrical grid to a voltage level compatible with the lighting. In some embodiments, the aperture 345 includes a transparent cover 350 mounted between the lighting, such as the LEDs, and the outside environment. In some embodiments, the transparent cover 350 is made of glass. In some embodiments, the transparent cover 350 is made of plastic. The transparent cover 350 is not limited to any particular transparent material. In some alternative embodiments, the transparent cover 350 is translucent.

Figure 35:
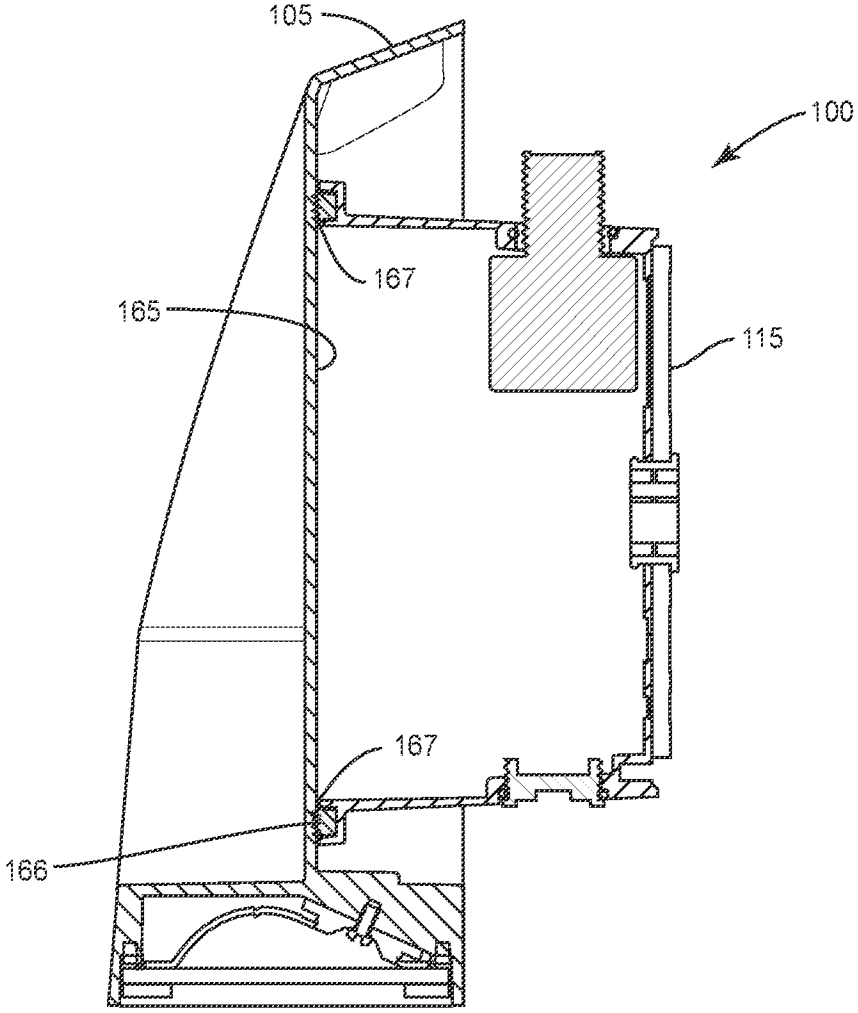
FIG. 35 is a side cross sectional view of the wall pack light fixture of FIG. 1.

Referring to FIG. 35, the wall pack light fixture 100 is shown in cross section. As can be seen, a seal 167 is formed where the front facing edge 166 meets the front cover contact surface 165. It can also be seen that the front cover 105 extends around and shelters the front facing edge 166 of the rear enclosure 115 to help protect it from the elements. In addition, because the hinge 110 is an offset hinge, uniform pressure is applied around all of the seal 167.

The wall pack light fixture can be provided with a power source (not shown) which can be a powerline and a battery backup in case of power failure. The electronics are controlled by a driver and COB, which exchanges signals with the occupancy sensor 265. If an occupant is detected, a signal can be sent to activate the driver and COB. When no occupant is inferred, the light can be de-activated. The battery test button can be routed through the COB to determine battery status.

Although the dimensions can be varied for different uses, an embodiment of the wall pack measures 11.1" in height and 9.5" in width with an assembled depth of 5.8" for the standard back box and 7.3" with the extended back box. The depth of the front cover is 4.1". The depth of the standard box is 3.2". The depth of the extended back box is 4.7".

Some embodiments herein describe a wall pack light fixture including a hinge, the hinge having a first portion and a second portion rotatably coupled to the first portion, a front cover, the front cover connected to the first portion of the hinge, the front cover including a light engine, and a rear enclosure, the rear enclosure connected to the second portion of the hinge.

Some other embodiments herein describe a wall pack light fixture including a hinge, the hinge having a first portion and a second portion rotatably coupled to the first portion, a front cover, the front cover connected to the first portion of the hinge, the front cover including a light engine, and a rear enclosure, the rear enclosure connected to the second portion of the hinge, the rear enclosure including an occupancy sensor Some still other embodiments herein describe a wall pack light fixture including a hinge, the hinge having a first portion and a second portion rotatably coupled to the first portion, a front cover, the front cover connected to the first portion of the hinge, the front cover including a light engine, wherein the light engine includes at least one of a light emitting diode (LED), a halogen light and an incandescent light, and a rear enclosure, the rear enclosure connected to the second portion of the hinge, the rear enclosure including an occupancy sensor and a battery backup, wherein the battery backup is electrically connected to the light engine and configured to provide electrical energy to the light engine in response to detection of an occupant by the occupancy sensor.

It will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. A wall pack light fixture, comprising:

a front cover having an overhang portion defining a recess and a front cover contact surface having a substantially flat contact portion facing in a rearward direction within the recess and at least one electronic component mounted on the front cover contact surface, the overhang portion having a plurality of sidewalls each extending from the substantially flat contact portion to a distal end; and a rear enclosure having a forward facing open front defined by a forward facing front edge;

a hinge having a first portion connected to the front cover on the distal end of one of the sidewalls and a second portion pivotably coupled to the first portion, the second portion connected to the rear enclosure on an exterior side surface of the rear enclosure behind the forward facing front edge such that a pivot point of the hinge is offset from a plane defined by the forwarding facing front edge;

wherein the front cover is rotatable about the hinge between a closed configuration, in which the front edge is pressed against and forms a seal with the substantially flat contact portion and the plurality of sidewalls at least partially circumscribe the forward facing front edge of the rear enclosure, and an open configuration in which the forward facing open front is entirely unobstructed by the front cover, and wherein the hinge is adapted to direct the front cover perpendicular to the front edge of the rear enclosure upon rotation from the open configuration to the closed configuration.

2. The wall pack light fixture according to claim 1, wherein the front edge of the rear enclosure comprises deformable material.

3. The wall pack light fixture according to claim 1, wherein the front edge of the rear enclosure comprises deformable material and the hinge is adapted so that the pressure of the front edge against the contact portion is substantially uniform.

4. The wall pack light fixture according to claim 1, wherein the front cover includes a light engine and the rear enclosure includes an enlarged portion and a battery backup within the enlarged portion, the battery backup electrically connected to the light engine.

5. The wall pack light fixture according to claim 4, wherein the rear enclosure includes an occupancy sensor that detects at least one of infrared light and motion coupled to the enlarged portion.

6. The wall pack light fixture according to claim 5, wherein the occupancy sensor has an adjustable sensitivity level.

7. The wall pack light fixture according to claim 4, wherein the light engine includes at least one of a light emitting diode (LED), a halogen light and an incandescent light.

8. The wall pack light fixture according to claim 1, wherein the front cover is made of die cast aluminum.

9. The wall pack light fixture according to claim 6, wherein the front cover is coated with a polyester powder.

10. The wall pack light fixture according to claim 1, wherein the front cover includes a finned section.

11. A wall pack light fixture, comprising:

a front cover having a front cover contact surface having a substantially flat contact portion circumscribing an inner region facing in a rearward direction, at least one electronic component mounted on the front cover contact surface within the inner region, and a plurality of sidewalls each extending from the substantially flat contact portion to a distal end;

a rear enclosure having a forward facing open front defined by a forward facing front edge having compressible material thereon;

an offset hinge having a first portion connected to the front cover on the distal end of one of the sidewalls and a second portion pivotably coupled to the first portion, the second portion connected to the rear enclosure on an exterior side surface of the rear enclosure behind the forward facing front edge such that a pivot point of the hinge is offset from a plane defined by the forwarding facing front edge;

wherein the front cover is rotatable about the hinge between a closed configuration, in which the front edge is pressed against and forms a seal with the substantially flat contact portion and the plurality of sidewalls at least partially circumscribe the forward facing front edge of the rear enclosure, and an open configuration in which the forward facing open front is entirely unobstructed by the front cover, the hinge adapted to direct the front cover in a perpendicular direction into the rear enclosure upon rotation from the open configuration to the closed configuration, wherein the pressure at the seal is substantially uniform, wherein the front cover includes a light engine and the rear enclosure includes an occupancy sensor.

12. The wall pack light fixture according to claim 11, wherein the rear enclosure includes an enlarged portion and a battery backup within the enlarged portion, the battery backup electrically connected to the light engine.

13. The wall pack light fixture according to claim 11, wherein the occupancy sensor detects at least one of infrared light and motion.

14. The wall pack light fixture according to claim 11, wherein the occupancy sensor has an adjustable sensitivity level.

15. The wall pack light fixture according to claim 11, wherein the light engine includes at least one of a light emitting diode (LED), a halogen light and an incandescent light.

16. The wall pack light fixture according to claim 11, wherein the front cover is made of die cast aluminum.

17. The wall pack light fixture according to claim 16, wherein the front cover is coated with a polyester powder.

18. The wall pack light fixture according to claim 11, wherein the front cover includes a finned section.

19. The wall pack light fixture according to claim 11, wherein the light engine includes at least one of a light emitting diode (LED), a halogen light and an incandescent light; and the rear enclosure includes a battery backup, wherein the battery backup is electrically connected to the light engine and configured to provide electrical energy to the light engine in response to detection of an occupant by the occupancy sensor.

* * * * *